US005433884A

United States Patent [19]

Altieri et al.

[11] Patent Number: 5,433,884

[45] Date of Patent: Jul. 18, 1995

[54] NONAQUEOUS LIQUID CLEANING PRODUCTS CONTAINING SOLUBILIZED BIOPOLYMER

[75] Inventors: Paul A. Altieri, Belle Mead; James Eden, East Millstone, both of N.J.; Michael C. Gribnau, Vlaardingen, Netherlands; Philippus C. Van Der Hoeven, Prinsenbeek, Netherlands; Leendert Hoogendijk; Helena M. De Roo, both of Vlaardingen, Netherlands; Daniel B. Solarek, Belle Mead, N.J.

[73] Assignee: Lever Brothers Company, Division of Conopco, Inc., New York, N.Y.

[21] Appl. No.: 160,535

[22] Filed: Dec. 1, 1993

[30] Foreign Application Priority Data

Dec. 3, 1992 [EP] European Pat. Off. ..... 92203752

[51] Int. Cl.[6] ..... C11D 3/22; C11D 3/37

[52] U.S. Cl. ..... 252/174.23; 252/174.17; 252/174.21; 252/DIG. 1

[58] Field of Search ..... 252/174.14, 174.21, 252/174.22, 174.23, DIG. 1; 127/29, 32, 65, 71

[56] References Cited

U.S. PATENT DOCUMENTS

| | | | |
|---|---|---|---|
| 3,630,775 | 12/1971 | Winkler | 127/71 |
| 3,904,429 | 9/1975 | Eastman et al. | 127/71 |
| 4,889,652 | 12/1989 | Sullivan et al. | 252/99 |
| 4,892,673 | 1/1990 | Dixit et al. | 252/114 |
| 4,931,195 | 6/1990 | Cad et al. | 252/8.8 |

FOREIGN PATENT DOCUMENTS

| | | |
|---|---|---|
| 58/138800 | 9/1983 | Japan . |
| 1303810 | 1/1973 | United Kingdom . |
| 1331349 | 9/1973 | United Kingdom . |
| 2169613 | 7/1986 | United Kingdom . |
| 2208653 | 11/1988 | United Kingdom . |
| 92/20772 | 11/1992 | WIPO . |

OTHER PUBLICATIONS

R. Whistler, "Starch: Chemistry & Technology", Academic Press, Inc., Fla. 1984, pp. 670–673.

G. Phillips et al., Gums & Stabilizers for the Food Industry, Oxford Univ. Press, N.Y., 1990 pp. 37–40.

*Primary Examiner*—Paul Lieberman
*Assistant Examiner*—Lorna M. Douyon
*Attorney, Agent, or Firm*—Ronald A. Koatz

[57] ABSTRACT

Non-aqueous liquid cleaning product comprising a liquid phase and dry particulate solubilized biopolymer material, that improves dispersibility, a method for preparing the biopolymer material and a method for preparing non-aqueous liquids comprising the biopolymer material.

7 Claims, No Drawings

NONAQUEOUS LIQUID CLEANING PRODUCTS CONTAINING SOLUBILIZED BIOPOLYMER

TECHNICAL FIELD

The present invention relates to substantially non-aqueous liquid cleaning products, especially detergent compositions and to a method of preparing a non-aqueous liquid. Non-aqueous liquids are those containing little or no water.

PRIOR ART & BACKGROUND

Non-aqueous liquid detergent compositions are known in the art and have been described in quite a number of patent publications, e.g. in U.S. Pat. Nos. 4,316,812, 4,874,537 and EP-A-0,484,095. Generally, the free water content of non-aqueous liquid detergent products is less than 5% by weight, preferably less than 2% by weight, more preferably substantially nil.

Non-aqueous liquid detergent compositions normally comprise a non-aqueous liquid phase having incorporated therein as dispersion, solution or combination thereof, the usual detergent components and adjuncts depending on the purpose of use, primarily surfactants and builders.

The liquid phase often comprises a nonionic surfactant as major component, which apart from acting as carrier liquid for the detergent components, usually and preferably also has detergent-active properties, thereby acting wholly or in part as the surfactant ingredient.

Non-aqueous liquids provide a way of concentrating liquid detergents without giving in on washing performance.

One weakness of non-aqueous liquid cleaning products is that on dilution with water, they may tend to suffer from gelling and the ingredients tend to stick together. As a consequence thereof, the product disperses only slowly in water and this may have a negative influence on the cleaning performance of the product, e.g. the product will not uniformly dissolve over the total of washing liquor on time. The gravity of this drawback is mainly dependent upon the type of liquid phase used in the formulation of non-aqueous liquid detergent compositions. This is for example true with liquid phases comprising a nonionic surfactant and/or surfactant mixtures, such as mixtures of C13–C15 alcohols with an average of 3 ethoxy groups and C13–C15 alcohols with an average of 7 ethoxy groups and liquid phases as described in GB 1,462,134, WO 91/12313, WO 91/14765 and EP-A-0,510,762.

It is an object of the present invention to improve the dispersibility of non-aqueous liquids.

SUMMARY OF THE INVENTION

It has now been found that the dispersibility of non-aqueous liquid detergent compositions can be substantially improved by incorporating therein an effective amount of dry particulate solubilised biopolymer material.

Therefore, the invention in its broadest aspect provides a non-aqueous liquid cleaning composition comprising a liquid phase and a dry particulate solubilised biopolymer material. The biopolymer material is preferably obtained by evaporating an aqueous biopolymer material solution.

A second embodiment of the invention relates to a method of preparing dry solubilised biopolymer material comprising dissolving a biopolymer material in water in a weight ratio of biopolymer material to water from 1:99 to 60:40, preferably to 35:65, whereafter the water is evaporated to an amount of lower than 15% by weight of the resulting material, whereafter the dry solubilised biopolymer material is subjected to milling and/or sieving.

A third embodiment relates to a method of preparing a non-aqueous liquid cleaning composition comprising a liquid phase and a dry particulate solubilised biopolymer material, wherein a biopolymer is dissolved in water, whereafter the water is evaporated, whereafter the resulting material is mixed with the non-aqueous liquid phase.

DETAILED DESCRIPTION OF THE INVENTION

The biopolymer material usable in the present invention may be selected from a wide variety of polymers. Preferred biopolymers are polysaccharides, saccharides, polypeptides and peptides. Examples of such biopolymers include starch, gelatin, pectin, casein, amylopectin (corn or potato) and custard.

Examples of starches are potato starch, wheat starch, corn starch, cereal starch, rice starch, tapioca starch and other modifications thereof, such as depolymerized starch. Preferred starches have a low or medium molecular weight and/or have a high amylopectine starches content stability and/or are pre-gelatinised.

The classification low or medium molecular weight starch is well-known in the art. Such weights can be achieved by e.g. acid-conversion, oxydation, enzyme hydrolysis and dextranisation.

A high amylopectine content of starch is preferred in view of improved solubility and dispersability. Preferably the amylopectine content is 70% by weight or higher, more preferably 80%, most preferably 90% or higher based on the dry material. Preferably the amylose content is low, e.g. 10% by weight of the dry material or less, more preferably 20% or less, most preferably 30% or less.

Preferably the starch material is pre-gelatinised.

Other examples of suitable biopolymer materials are amylose, tylose, whey proteins and zein, hemicelluloses, pentosans, chitin (e.g. derived form Shellfish), seaweed extracts (such as carrageenans, agar and furcelleran), pectines from plants and gums from different sources such as arabic karya, tragacanth, locust bean, guar, xanthan and waxy corn starch. Further examples are cellulose ethers (such as methylcellulose, ethylcellulose, hydroxylethylcellulose, methylhydroxy-ethyl-cellulose and methylhydroxy-propyl-cellulose) and starch ethers (such as hydroxyethylstarch and methylstarch).

The biopolymer material may be modified, e.g. with various ether and/or ester linkages, say with C1 to C20 alkyl side chains. Examples of such modifications are octenylsuccinate or hydroxypropyl modified starches.

The degree of substitution (ds-value) is a term that is well-known in the art. Basically, it reflects the degree to which the -OH groups have been converted with substituent groups. Suitable ds-values for the starches are lower than 0.7, preferably 0.5 or lower, more preferably 0.3 or lower, most preferably 0.2 or lower, in particular 0.1 or lower. The ds-value may be 0 or at least 0.01 or at least 0.02. Alginate has a ds value of 1.0 and SCMC of 0.7 or higher.

An advantage of the use of these biopolymers is their natural source, which makes their synthesis and use environmentally acceptable.

The solubilised biopolymer material is incorporated in the non-aqueous liquid in particulate form. Very small particles are less desirable, because of dust during processing, whereas too large particles may yield grittiness. For the purpose of the invention the upper limit of the particle size is only determined by practical considerations and/or constraints. Suitable particles generally will have a size of up to 2000 μm, preferably smaller than 1000 μm, more preferably smaller than 500 μm, particularly smaller than 400 μm, e.g. smaller than 350 μm, 320 μm, 300 μm or even 250 μm. The particle size may even be of sub-μm size. Generally, a particle size greater than 0.1 μm can be suitable used. Preferred particles will be of a size greater than 1.0 μm, more preferably greater than 10 μm, most preferably greater than 50 μm, in particular greater than 80 μm, e.g. greater than 100 μm. Preferably, the weight average particle size D(3,2) (as defined hereunder) of the biopolymer material according to the invention corresponds to the above ranges. Preferably the majority of particles i.e. >80% have a particle size within the range of 100–250 μm.

The biopolymer material may be used in the composition at levels of up to 80% by weight of the composition, preferably of up to 40%, more preferably of up to 20%, particularly preferred of up to 10%, e.g. lower than 5% by weight. The lower level will generally be about 0.01% by weight of the composition, preferably 0.1%, more preferably 0.2% and most preferably 0.5%, in particular 1.0% by weight.

Preferably, the biopolymer material of the present invention has a density of around 1.0 g/ml, say at least 0.6 g/ml, preferably at least 0.8 g/ml and say at most 2.2 g/ml and preferably at most 1.3 g/ml, in particular from 1.0 to 1.3 g/ml.

METHOD OF PREPARING THE SOLUBILISED BIOPOLYMER

A method for preparing the dry particulate solubilised biopolymer material is as follows. A biopolymer material is dissolved in water, whereafter the water is allowed to evaporate to leave a solid material having a low water content. Preferably, the resulting material is subjected to milling and/or sieving, e.g. to particle sizes as indicated above, and then mixed with the non-aqueous phase of the non-aqueous liquid.

Preferably, the biopolymer material is mixed with water in a weight ratio of biopolymer material to water of up to 60:40 or to 50:50, a suitable ratio range being to 40:60, for example from 1:99 to for example 35:65, preferably from 2:98 to 30:70, more preferably from 3:97 to 25:75, and thereafter heated as desired, e.g. by short boiling of the mixture to cause dissolution of the biopolymer material in the water. It is preferred that the level of water is kept as low as possible, e.g. in the range of from 50 to 75% by weight.

The water of the mixture of biopolymer material and water is then evaporated. This can be done using several drying methods as indicated hereunder. Also combinations thereof can be used.

Using tray drying, the solution can be left to stand so as to allow the water to evaporate. The temperature at which evaporation takes place will preferably be lower than 80° C., more preferably less than 50° C. The best results are obtained between 5° C. and 50° C. The evaporation process may be carried out in less than 1 hour, though preferably at least 1 hour, more preferably at least 5 hours. Of course, the resulting material can be subjected to higher temperatures at the beginning or at the end of the evaporation process, e.g. to eliminate any small water traces in a stove at 80° C. or higher.

Band drying is another useful method, preferably in combination with vacuum drying. The solution may for example be sprayed on a band in a chamber, preferably being vacuum i.e. having a pressure of say from 10–20 mbar. The mixture is dried, e.g. in at least 10 minutes, say in about 30 minutes. This method has the advantage that it can easily be applied continuously.

Drum drying can also be used, i.e. the mixture of biopolymer and water is sprayed on a turning drum, e.g. having a diameter of 300 mm and turning at a speed of 0.2 rpm. The dry solubilised biopolymer material is scraped from the drum. This method has the advantage that it can easily be applied continuously.

Another method is spray drying a mixture of biopolymer and water. Inlet temperatures of e.g. at least 150° C., preferably at least 180° C., more preferably at least 200° C. may be used and preferably at most 300° C., more preferably at most 280° C., most preferably at most 260° C., e.g. between 220° and 230° C. Exhaust temperatures (and product outlet temperature) may be used of e.g. at least 50° C., preferably at least 60° C. more preferably at least 70° C. and preferably at most 120° C. more preferably at most 110° C., most preferably at most 100° C., e.g. between 80° and 90° C. This method has the advantage that it can easily be applied continuously.

Another method is extrusion of a mixture of biopolymer and water, e.g. using temperatures from 70° C. to 130° C. preferably from 80° C., more preferably from 90° C. and preferably to 120° C., more preferably to 110° C., say around 100° C. Optionally the dry solubilised biopolymer material is chopped in little pellets. This method has the advantage that it can easily be applied continuously.

Other methods of evaporation may also be applied alone, in combination or in combination with the above methods, such as freeze drying, microwave drying, vacuum drying. Preferably, spray drying or extrusion or a combination thereof is used.

Preferably the water content of the resulting biopolymer is not more than about 15% by weight, say less than about 13%, more preferably less than 12% by weight, most preferably less than 10% by weight. Suitable levels of water are 0% or higher, but preferably at least 1%, more preferably at least 3%, most preferably higher than 5%, in particular 7% or higher. In fact, contrary to what would be expected, use of these water levels can be tolerated, even when one is preparing non-aqueous liquids.

The resulting material may be sieved and/or milled, as appropriate, to achieve the above particle size distribution. Milling can be carried out by means of a wide variety of size reduction equipment such as a mortar, a Janke & Kunkel Analysen Mühle A-10 at 20.000 rpm (rounds per minute), a ball, colloid, air classification and/or hammer mill. As desired, the material can subsequently be sieved to the required particle size. The temperature during milling should preferably be kept below the melting point of the material in order to avoid plasticising.

Without wishing to be bound by any theory, it is believed that, in water, the biopolymer material forms irregularly structured aggregates with relatively wide channels (on an atomic-scale) through which water can diffuse freely. Upon evaporation, the aggregates loose water and the channels narrow. This morphology change of the biopolymer material may influence the hydration of the components resulting in good dispersibility of the non-aqueous liquid.

SURFACTANTS

As explained hereinbefore the liquid phase of non-aqueous liquid detergent compositions often and preferably comprises a liquid nonionic surfactant as major component.

Nonionic detergent surfactants are well-known in the art. They normally consist of a water-solubilizing polyalkoxylene or a mono- or di-alkanolamide group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylenes. Also common are fatty acid mono- and dialkanolamides in which the alkyl group of the fatty acid radical contains from 10 to about 20 carbon atoms and the alkyloyl group having from 1 to 3 carbon atoms. In any of the mono- and di- alkanolamide derivatives, optionally, there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in EP-A-225,654, especially for use as all or part of the liquid phase. Also preferred are those ethoxylated nonionics which are the condensation products of fatty alcohols with from 9 to 15 carbon atoms condensed with from 3 to 11 moles of ethylene oxide. Examples of these are the condensation products of $C_{11-13}$ alcohols with (say) 3 or 7 moles of ethylene oxide. These may be used as the sole nonionic surfactants or in combination with those of the described in the last-mentioned European specification, especially as all or part of the liquid phase.

Another class of suitable nonionics comprise the alkyl polysaccharides (polyglycosides/oligosaccharides) such as described in any of specifications U.S. Pat. Nos. 3,640,998; 3,346,558; 4,223,129; EP-A-92,355; EP-A-99,183; EP 70,074, '75, '76, '77; EP 75,994, '95, '96.

Mixtures of different nonionic detergent surfactants may also be used. Mixtures of nonionic detergent surfactants with other detergent surfactants such as anionic, cationic or ampholytic detergent surfactants and soaps may also be used.

Preferably the level of nonionic surfactants is from 10–90% by weight of the composition, more preferably from 20–70%, most preferably from 35 to 50%.

While nonionic surfactants are quite effective at oily and greasy soil removal (e.g. sebum), particulate soils, such as clay soils and the like, may be more effectively removed by anionic surfactants. Thus within the ambit of the present invention, a very wide variation in surfactant types and levels is possible. The selection of surfactant types and their proportions will be fully within the capability of those skilled in the art.

Useful composition within the invention normally comprise blends of different surfactant types. Typical blends include those where the primary surfactants comprise a nonionic and/or non-alkoxylated anionic and/or alkoxylated anionic surfactant. Cationic, zwitterionic and amphoteric surfactants may also be present usually in minor amounts as desirable. These and other surfactants are described in "Surface Active Agents" Vol. I, by Schwartz & Perry, Interscience 1949; "Surface Active Agents" Vol II, by Schwartz, Perry & Berch, Interscience 1958; the current editions of "McCutcheon's Emulsifiers & Detergents" published by the McCutcheon Manufacturing Confectioners Company; in "Tensid-Taschenbuch" H. Stache 2nd Edition, Carl Hanser Verlag, München & Wien, 1981; and in the various patent literature describing various types of liquid detergent compositions, which for the purpose of the invention need no further detailing.

OTHER LIQUID MATERIALS

Examples of other liquid materials which may be present in the liquid phase are liquid bleach precursors such as for example glyceroltriacetate, solvent materials for example ethanol and dodecanol and deflocculant material, as described in EP-A-266199 (Unilever). The level of liquid bleach precursors is preferably 0–20% by weight, more preferably 1–25%, most preferably 2–10%.

The level of solvents other than nonionic surfactants is preferably from 0–20%, most preferably 0–15%, more preferably 0–10% by weight.

Deflocculant material may be present, preferably at levels of from 0–15% by weight, in many cases the level is at least 0.01%, usually 0.1% or more preferred at least 1% by weight, and may be as high as 15% by weight. For most practical purposes, the amount ranges from 2–12%, preferably from 4–10% by weight, based on the final composition.

SOLID PARTICLES

The compositions may comprise a solid dispersed phase other than the biopolymer material according to the invention. In that case, the liquid phase may preferably constitute from 10 to 100% by weight, more preferably 20–80% and most preferably from 30–60% by weight of the composition.

The solid phase—if any—may comprise one or more ingredients selected from bleach materials, solid bleach activators, builders, abrasives, enzymes and minor ingredients such as fluorescers, which particles size may not necessarily be the same as that of the biopolymer material.

Usually the particle size of the solid phase (other than the biopolymer material according to the invention) defined in terms of D(3,2) will be less than 100 μm, preferably not more than 30 μm, more preferably up to 10 μm. Usually the D(3,2) of the solid phase is more than 0.1 μm, preferably at least 1 μm and more preferably at least 2.5 μm. For the purpose of the present invention references to the D(3,2) average particle diameter refer to the D(3,2) particle size, which is the average surface weighted, volume/weight mean diameter calculated as described by M. Alderliesten, Anal. Proc. Vol. 21, May, 1984, 167–172. The particle size can for example be determined by using a Malvern Mastersizer or a Coulter LS 130, as appropriate.

BLEACHES

Bleaches include the halogen, particularly chlorine bleaches such as are provided in the form of alkalimetal hypohalites, e.g. hypochlorites. In the application of fabrics washing, the oxygen bleaches are preferred, for example in the form of an inorganic persalt, preferably with a bleach precursor or as a peroxy acid compound.

In the case of the inorganic persalt bleaches, the bleach precursor or activator makes the bleaching more effective at lower temperatures, i.e. in the range from ambient temperature to about 60° C., so that such bleach systems are commonly known as low-temperature bleach systems and are well-known in the art. The inorganic persalt such as sodium perborate, both the monohydrate and the tetrahydrate, acts to release active oxygen in solution, and the activator is usually an organic compound having one or more reactive acyl residues, which cause the formation of peroxy acids, the latter providing for a more effective bleaching action at lower temperatures than the peroxybleach compound alone. The ratio by weight of the peroxybleach compound to the activator is from about 20:1 to about 1:1, preferably from about 10:1 to about 1.5:1. The preferred level of the peroxybleach compound in the composition is from 0–30% by weight, more preferably 2–20%, most preferably 4–15%, while the preferred level of the activator is from 0–20% by weight, more preferably 1–10%, most preferably 2–8%.

Typical examples of the suitable peroxybleach compounds are alkalimetal perborates, both tetrahydrates and monohydrates, alkali metal percarbonates, persilicates and perphosphates, of which sodium perborate and sodium percarbonate are preferred. A preferred bleach activator is TAED.

A further preferred class of bleach activators is that of hydrophobic peroxy acid bleach precursors, such as sodium nonanoyloxy benzene sulphonate and sodium -3,5,5- trimethyl hexanoyloxy benzene sulphonate. These activators are deemed to cause less (local) dye damage.

In certain cases and for particular reasons it may be desirable to also include a bleach catalyst, such as a transition metal compound or complex and the sulphonimines as described in U.S. Pat. Nos. 5,041,232 and 5,047,163, which may be used instead of or together with said bleach activators. A specifically preferred bleach catalyst for use herein is a manganese complex of formula $[Mn^{IV}_2(\mu\text{-}O)_3(Me\text{-}MeTACN)_2](PF_6)_2$ as described in EP-A-O,458,397 and EP-A-0,458,398. Another preferred bleach catalyst is a manganese complex as described in our co-pending GB patent application 9127060.3. Alternatively the ligand and a manganese source can be separately added such as is described in co-pending GB application 9204706.7.

It is particularly preferred to include in the compositions, a stabiliser for the bleach or bleach system, for example hydroxyethylidene-1,1-diphosphonic acid, ethylene diamine tetramethylene phosphonate and diethylene triamine pentamethylene phosphonate or other appropriate organic phosphonate or salt thereof, such as the Dequest® range hereinbefore described. These stabilisers can be used in acid or salt form, such as the calcium, magnesium, zinc or aluminium salt form. The stabiliser may be present at a level of up to about 1% by weight, preferably between about 0.1% and about 0.5% by weight.

DETERGENCY BUILDERS

The detergency builders are those materials which counteract the effects of calcium, or other ion, water hardness, either by precipitation or by an ion sequestering effect. They comprise both inorganic and organic builders. They may also be sub-divided into the phosphorus-containing and non-phosphorus types, the latter being preferred when environmental considerations are important.

In general, the inorganic builders comprise the various phosphate-, carbonate-, silicate-, borate- and aluminosilicates-type materials, particularly the alkalimetal salt forms. Mixtures of these may also be used.

Examples of phosphorus-containing builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic builders, when present, include water-soluble alkali metal carbonates, bicarbonates, borates, silicates, metasilicates, and crystalline and amorphous aluminosilicates. Specific examples include sodium carbonate (with or without calcite seeds), potassium carbonate, sodium and potassium bicarbonates, silicates such as sodiummetasilicate and zeolites.

Examples of organic builders include the alkali metal, ammonium and substituted ammonium, citrates, succinates, malonates, fatty acid sulphonates, carboxymethoxy succinates, ammonium polyacetates, carboxylates, polycarboxylates, aminopolycarboxylates, polyacetyl carboxylates and polyhydroxysulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid. Other examples are organic phosphonate type sequestering agents such as those sold by Monsanto under the tradename of the Dequest® range and alkanehydroxy phosphonates.

Other suitable organic builders include the higher molecular weight polymers and co-polymers known to have builder properties, for example appropriate polyacrylic acid, polymaleic acid and polyacrylic/-polymaleic acid co-polymers and their salts, such as those sold by BASF under the Sokalan® Trade Mark. Polyacrylates or their derivatives may also be useful for their anti-ashing properties.

Preferably the level of builder materials is from 5–50% by weight of the composition, more preferably 10–40%, most preferably 15–35%.

OTHER OPTIONAL INGREDIENTS

Other ingredients comprise those remaining ingredients which may be used in liquid cleaning products, such as fabric conditioning agents, enzymes, perfumes (including deoperfumes), fluorescent agent, micro-biocides, colouring agents, soil-suspending agents (anti-redeposition agent), corrosion inhibitors, enzyme stabilising agents, and lather depressants.

Amongst the fabric conditioning agents which may be used, either in fabric washing liquids or in rinse conditioners, are fabric softening materials such as fabric softening clays, quaternary ammonium salts, imidazolinium salts, fatty amines and cellulases.

Enzymes which can be used in liquids according to the present invention include proteolytic enzymes (protease), amylolytic enzymes (amylase), lipolytic enzymes (lipases) and cellulolytic enzymes (cellulase). Various types of proteolytic enzymes and amylolytic enzymes are known in the art and are commercially available. They may be incorporated as "prills", "marumes" or suspensions e.g.. Preferably enzymes are added as suspensions in a non-aqueous liquid surfactant. The preferred level of enzyme materials is from 0.01 to 5% by weight of the composition.

The total amount of the fluorescent agent or agents used in a detergent composition is generally from 0.02–2% by weight.

When it is desired to include anti-redepostion agents in the liquid cleaning products, the amount thereof is normally from about 0.1% to about 5% by weight, preferably from about 0.2% to about 2.5% by weight of the total liquid composition. Preferred anti-redeposition agents include carboxy derivatives of sugars and celluloses, e.g. sodium carboxymethyl cellulose, anionic poly-electrolytes, especially polymeric aliphatic carboxylates, or organic phosphonates.

EXAMPLE I–II

A non-aqueous liquid base-composition was prepared by mixing the following ingredients in the listed order:

| BASE PRODUCT | % by weight of |
|---|---|
| Alkoxylated nonionic 1) | 23.3 |
| Alkoxylated nonionic 2) | 19.3 |
| Alkyl Benzene sulfonic acid 3) | 6.1 |
| Glyceroltriacetate | 5.1 |
| Antifoam | 1.2 |
| Sodium carbonate | 17.0 |
| Calcite | 6.1 |
| Polymer 4) | 1.5 |
| SCMC | 1.5 |
| Brightner | 0.1 |
| Silica | 3.0 |
| Perborate 1 aq. | 10.7 |
| TAED | 5.1 |
| Total | 100.00 |

1) Vista 1012-62 ® ex Novel; C10–C12 alkyl and on average 6.5 Ethoxated nonionic
2) Marlipal 013/60 ®; on average 3 Ethoxylated nonionic ex Hüls AG
3) Marlon ® AS3 ex Hüls AG
4) Versa TL3-X ® ex National Starch and Chemical Company To the above base composition was added the following three different biopolymer materials in an amount of 2.5% by weight relative to the base composition.

Biopolymer A: Commercial potato starch, as such.

Biopolymer I: Starch was dissolved in water (5% by weight solution), by shortly boiling the mixture, after which the water was evaporated at room temperature for 3 days. The resulting solid glassy material, comprising less than 10% by weight of water, was milled in a Janke & Kunkel Analysen Mühle A-10 at 20.000 rpm and sieved to a particle size of smaller than 300 μm.

Biopolymer II: Starch was dissolved in water (13.33% by weight solution), by shortly boiling the mixture, after which the water was evaporated by freeze drying at a temperature of 20° C. for 16 hours. The resulting solid material was milled with a Janke & Kunkel Analysen Mühle A-10 at 20.000 rpm and sieved to a particle size of smaller than 300 μm.

The dispersibility of the base product was compared with the dispersibility of compositions A, I and II by way of the following method: 1 gram of the composition was added and spread on a damped WFK-10E cloth (ex WFK, Krefeld) and after 4 minutes, 1 liter water was added to the cloth. After 1 minute, the water was stirred (stirrer was placed 2.5 centimeters above the cloth and rotated at 150 rpm). The dispersibility of the products as determined by conductivity measurement, expressed in time needed to achieve 100% dissolution level, is tabulated below:

TABLE 1

| Formulation | time (in minutes) |
|---|---|
| Base | 30 |
| Base and biopolymer A | >30 |
| Base and biopolymer I | 17 |
| Base and biopolymer II | 23 |

The results show that the compositions I and II containing solubilised biopolymer material according to the invention had superior dispersibility over the base composition and composition A outside the invention.

EXAMPLE III–VI

Four compositions were prepared from the same base composition as used in Example I, with four solubilised biopolymer materials at varying levels.

Biopolymer III: Starch was dissolved in water (10% by weight solution) by shortly boiling the mixture. The water was allowed to evaporate at room temperature for 3 days. The resulting material had a water content of 11% by weight and was milled with a Janke & Kunkel Analysen Mühle A-10 at 20.000 rpm and sieved to a particle size of 180 to 300 μm.

Biopolymer IV: Starch was dissolved in water (20% by weight solution) by shortly boiling the mixture. The water was evaporated at 70° C. for 7 hours. The resulting solid glassy material had a water content of 11% by weight and was milled with a Janke & Kunkel Analysen Mühle A-10 at 20.000 rpm and sieved to a particle size of 180 to 300 μm.

Biopolymer V: Starch was dissolved in water (20% by weight solution) by shortly boiling the mixture. The water was evaporated in a standard microwave oven for 13 minutes. The resulting material had a water content of 5% by weight and was milled with a Janke & Kunkel Analysen Mühle A-10 at 20.000 rpm and sieved to a particle size of smaller than 180 μm.

Biopolymer VI: Starch was dissolved in water (20% by weight solution) by shortly boiling the mixture. The water was evaporated in a standard microwave oven for 13 minutes. The resulting material had a water content of 5% by weight and was milled with a Janke & Kunkel Analysen Mühle A-10 at 20.000 rpm and sieved to a particle size of 180 to 300 μm.

Dispersibility: The same experimental set-up as in example I was used to determine the dispersibility of the compositions with the following conditions: 2 gram of detergent composition was added and spread on a dry CSG cloth (cotton, sulfur treated green); after 2 minutes 1 liter of water was added; the solution was stirred. The stirrer was placed 2 cm above the cloth and turned with 150 rpm.

Dye spotting: Dye spotting of the detergent composition on the cloth was determined by measuring the difference in reflectance at 460 nm of the bleach spot and the remaining area on the CSG cloth after the experiment. A higher ΔR indicates more colour loss due to dye spotting. The results are shown in table 2:

TABLE 2

| Formulation | time (in minutes) | dye spotting (ΔR at 460 nm) |
|---|---|---|
| Base | 38 | 9.3 |
| Base and 2.5% biopolymer III | 20 | 6.6 |
| Base and 2.5% biopolymer IV | 25 | 7.4 |
| Base and 5% biopolymer V | 26 | 7.6 |
| Base and 2.5% biopolymer VI | 36 | 8.2 |

The results show that compositions containing the biopolymer material of the invention show improved dispersibility and less dye spotting as compared with the base composition.

EXAMPLE VII

A process of preparing dry particulate solubilised biopolymer material using spray-drying and extrusion techniques that can be used in non-aqueous liquids is as follows. 35% starch is dissolved in 65% water; the dispersion is cooked at 80° to 90° C. to obtain a clear solution. The solution is cooled to 50° C.; The solution is hold at 50° C. The solution is then spray-dried. Air inlet temperatures are around 225° C. and exhaust air temperature product outlet temperature are about 85° C. The spray-dried powder (50 to 80 μm in diameter) is blended 1:1 with starch and extruded under addition of about 12% process water, which is evaporated during the extrusion. Product temperature ex-extruder is around 100° C. moisture content about 10%. At the extruder outlet, the product is chopped into little pellets, typically 15 mm in diameter and 5 to 10 mm thick. The extruded material is dried on a belt equipped with fans. Typical moisture content at the end of the 5 m long belt is about 8%. The extruded material is milled in an air-classifying mill to 90 to 250 μm particles. Non-aqueous liquids comprising 2% of this dry particulate solubilised biopolymer material show improved dispersability.

We claim:

1. A non-aqueous liquid cleaning composition comprising from 10 to 90% by weight of liquid nonionic surfactant material and from 0.01% to 80% by weight of a dry particulate solubilized biopolymer material selected from the group consisting of polysaccharides, monosaccharides, polypeptides, monopeptides and mixtures thereof, said biopolymer material having a weight average particle size D(3,2) between 100 and 500 μm and a high density of from 0.8 to 2.2 g/ml, wherein the biopolymer material is obtained by evaporating an aqueous biopolymer material solution.

2. A composition according to claim 1, characterised in that the biopolymer material is present in an amount of from 0.01 to lower than 5% by weight of the composition.

3. A composition according to claim 1, characterised in that the biopolymer has a degree of substitution value (ds-value) of lower than 0.7.

4. A composition according to claim 1, characterised in the amylopectine content of the biopolymer is 70% by weight or higher.

5. Method of preparing a non-aqueous liquid cleaning composition comprising from 10% to 90% by weight of liquid nonionic surfactant material and from 0.0% to 80% by weight of a dry particulate solubilized biopolymer material selected from the group consisting of polysaccharides, monosaccharides, polypeptides, monopeptides and mixtures thereof, said biopolymer material having a weight average particle size D(3,2) between 100 and 500 μm and a high density of from 0.8 to 2.2 g/ml, wherein a biopolymer is dissolved in water, whereafter the water is evaporated, whereafter the biopolymer material that results is mixed with the nonionic surfactant material.

6. Method according to claim 5, wherein the water is evaporated to an amount of lower than 15% by weight of the resulting material.

7. Method according to claim 5, wherein the resulting biopolymer material is milled and/or sieved.

* * * * *